US005452950A

United States Patent [19]

Crenshaw et al.

[11] Patent Number: 5,452,950

[45] Date of Patent: Sep. 26, 1995

[54] DESK-STATION, COMPUTERIZED SCHOOL DESK

[76] Inventors: Ralph E. Crenshaw, 4335 Blackford Ave. #1, San Jose, Calif. 95129; Manuel Ruiz, E-84355 P.O. Box 409000, Ione, Calif. 95640

[21] Appl. No.: 228,113

[22] Filed: Apr. 15, 1994

[51] Int. Cl.[6] ..... A47B 39/00; A47B 83/02; A47B 91/08

[52] U.S. Cl. ..... 312/223.3; 312/223.6; 312/235.2; 312/235.3; 297/170; 297/174; 248/918; 361/680; 361/681; 361/685

[58] Field of Search ..... 312/223.3, 223.6, 312/235.2, 235.5, 235.6, 235.8; 297/170, 171, 174; 361/685, 680, 681, 682; 248/918

[56] References Cited

U.S. PATENT DOCUMENTS

| | | | |
|---|---|---|---|
| 2,024,045 | 12/1935 | Johnson | 312/235.3 X |
| 2,115,497 | 4/1938 | Mintz | 312/235.2 X |
| 3,770,334 | 11/1973 | Weber | 312/235.2 X |
| 4,562,482 | 12/1985 | Brown | 312/223.3 X |
| 4,735,467 | 4/1988 | Walters | 312/223.3 X |
| 4,766,422 | 8/1988 | Walters et al. | 312/223.3 X |
| 4,779,922 | 10/1988 | Cooper | 297/174 X |
| 4,792,881 | 12/1988 | Wilson et al. | 312/223.6 X |
| 4,798,411 | 1/1989 | Lin | 297/170 |
| 4,915,450 | 4/1990 | Cooper | 297/174 X |

*Primary Examiner*—Kenneth J. Dorner
*Assistant Examiner*—Rodney B. White

[57] ABSTRACT

A school desk or table with a smooth writing surface (88), which when in the open position (FIGS. 4 , and 4A) can be utilized as a computer work station on a local area network. The video display (14) is of the thin variety (LCD type); the input device (34) would include a keyboard and a track-ball mouse. Student work can be stored either on the file server or on a floppy disk using a floppy drive (72). The network cable (46A) and power cable (46B) are routed through the desk frame into the computer station underside and connect each individual station to the network and centralized power supply. The desk-station is unlocked by a servo motor (52) which is activated upon powering up the main power supply.

9 Claims, 6 Drawing Sheets

DESK-STATION, COMPUTERIZED SCHOOL DESK

BACKGROUND-FIELD OF INVENTION

This invention relates to a computer workstation device, specifically one that is in the form of a school desk.

BACKGROUND-DESCRIPTION OF PRIOR ART

Computer workstations have become common in schools. Such workstations usually consist of a desktop computer, color video display, keyboard and mouse. Originally the expense of such workstations made them less available to schools, and the ones that eventually became available were confined to Junior High and High School levels.

During the mid to late 1980's computer prices began to drop, due to market competition, which in return made computers more available to schools.

Besides the financial shortcomings the typical computer workstation setup suffers from a number of disadvantages:

(a) They are large and cumbersome, and take a lot of desk space, leaving no room for books or writing space. A number of manufacturers have produced various types of computer furniture such as the Ultra-View and PC View-Thru workstations as advertised by Global Computer Supplies, March 1994 Catalog. These tables and desks are modified so that the video display monitor is sunken into the table and tilted at an angle, in an effort to relieve neck and eye strain caused by constantly looking from the keyboard to the monitor. But none of these devices serve as space savers or would be practical for schools.

(b) A regular classroom does not take advantage of the computer as a teaching tool and, conversely, a computer dedicated classroom, as currently structured, detracts from student-teacher interaction, as every individual is focused on their own workstation.

(c) All video display monitors of the cathode-ray variety, the ones currently found in schools, emit an electromagnetic field of extremely low frequency (ELF) radiation and very low frequency (VLF) radiation. Concerns over the long term exposure to these emissions has prompted governments to regulate the exposure levels and have created standards, such as the MPRII standard promoted by the Swedish Government Department of Labor, which defines acceptable levels of ELF and VLF radiation as to the amount and direction that can be emitted. Acceptable levels must not exceed 200 nanoteslas of ELF and 25 nanoteslas of VLF. But even the most rigid of standards cannot prevent the unforeseeable consequences of long term exposure to such radiations, especially in children during their growing years. The use of LCD type video displays would reduce such risks.

(d) Typical workstations in the school environment are stand alone PC which are good to teach individual computer skills, but are less effective as a general teaching tool. They require the computer classroom to be dedicated exclusively to computing and tend to submerge the student into their own work, detracting from interaction and centralization around the teacher.

OBJECTS AND ADVANTAGES

Accordingly, the objects and advantages of the desk-station are:

(a) It will effectively eliminate the problem of bulkiness and loss of space, by doubling as both a computer workstation and an ordinary school desk with a normal size writing surface.

(b) In the open position the keyboard and trackball type mouse are at hand. They form one unit and are inset into the desk, which minimizes the chance of removal or accidentally being dropped, and eliminates cumbersome wire connections.

(c) It uses a liquid crystal, plasma or active-matrix type of display, which enables the overall size of the desk to be no more than 3 inches thick once closed. Such displays are well below the MPRII emission standards of electromagnetic fields.

(d) The individual desk-stations are interconnected in a network configuration, under the control of a single file server, monitored by the instructor at his or her desk, which would allow for instant monitoring of students progress, would facilitate student-teacher interaction, and centralized teaching, while at the same time meeting the particular student needs, such as those of with learning disabilities.

(e) Thanks to the remote electronic locking mechanism, the desk-station can only be unlocked from the instructor's desk, providing for greater comfort and security.

(f) Due to the versatility of the desk-station, any current classroom can be easily modified to implement our invention, would allow for greater versatility of the classroom environment, allow easy transition from regular classroom setting to a computer based teaching environment, providing every teacher with an invaluable teaching tool.

DRAWING FIGURES

In the drawings, closely related figures have the same number but different alphabetic suffixes.

REFERENCE NUMERALS IN DRAWINGS

Figure 1:
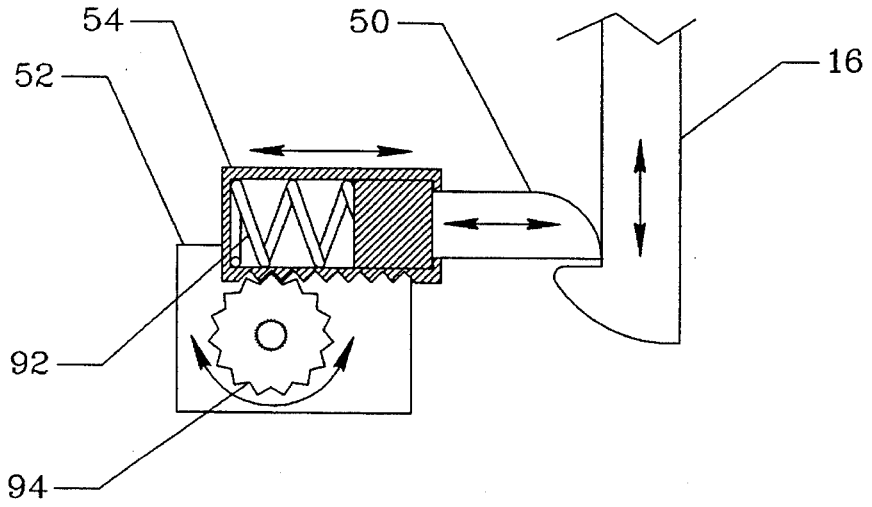
FIG. 1 shows the remote electronic locking mechanism.

10 floppy drive cover
12 display shell
14 video display
16 ridged lock latch
18A–D female screw attachments
20A–B notch
22 display cutout
24 lock latch cutout
26 screws
54 spring and latch casing
56A–D ribbon cables
58 video/floppy card
60 fan
62 mother board
64 wire access

66 component shell hinge
68 wire protector
70 hinge hole
28 display shell cover hinge
30 hinge pin
32A–D screws
34 input device
36 component shell cover
38 lock latch cutout
40 component shell
42A–D female screw attachments
44 network interface card
46A network cable
46B power cable
48 cable access hole
50 spring loaded lock latch
52 servo motor
72 floppy drive
74 hole
76 frame
78 seat
80 book rack
82A–D holes
84 flaps
86 pencil holder
88 writing surface
90 hole
92 spring
94 gear
96 keyboard cable
98 display shell cover

DESCRIPTION-FIGS. 1 to 5

Figure 2:
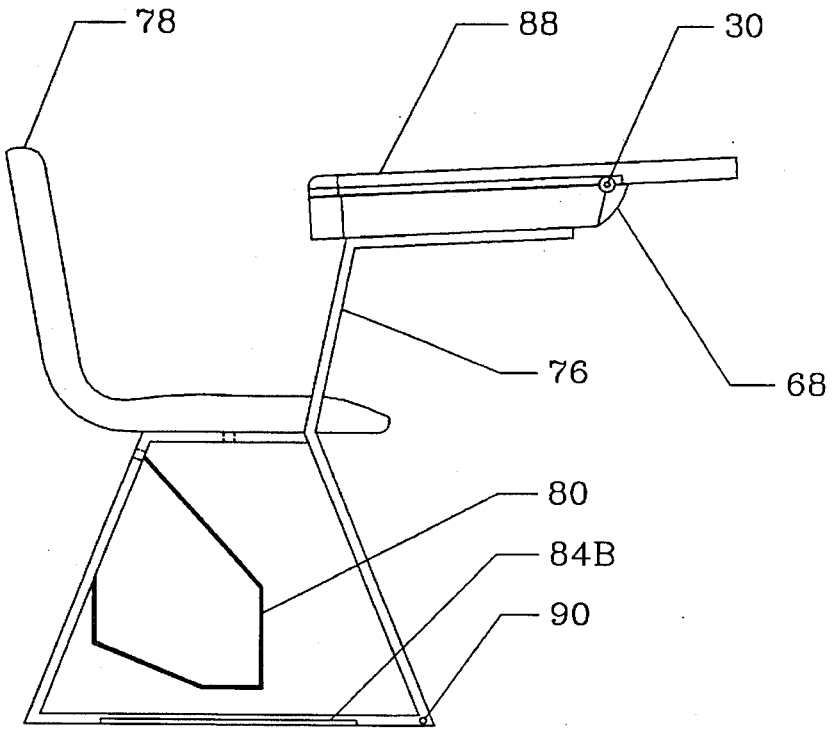
FIG. 2 shows the left side view of the desk-station, in the closed position.
Figure 3:
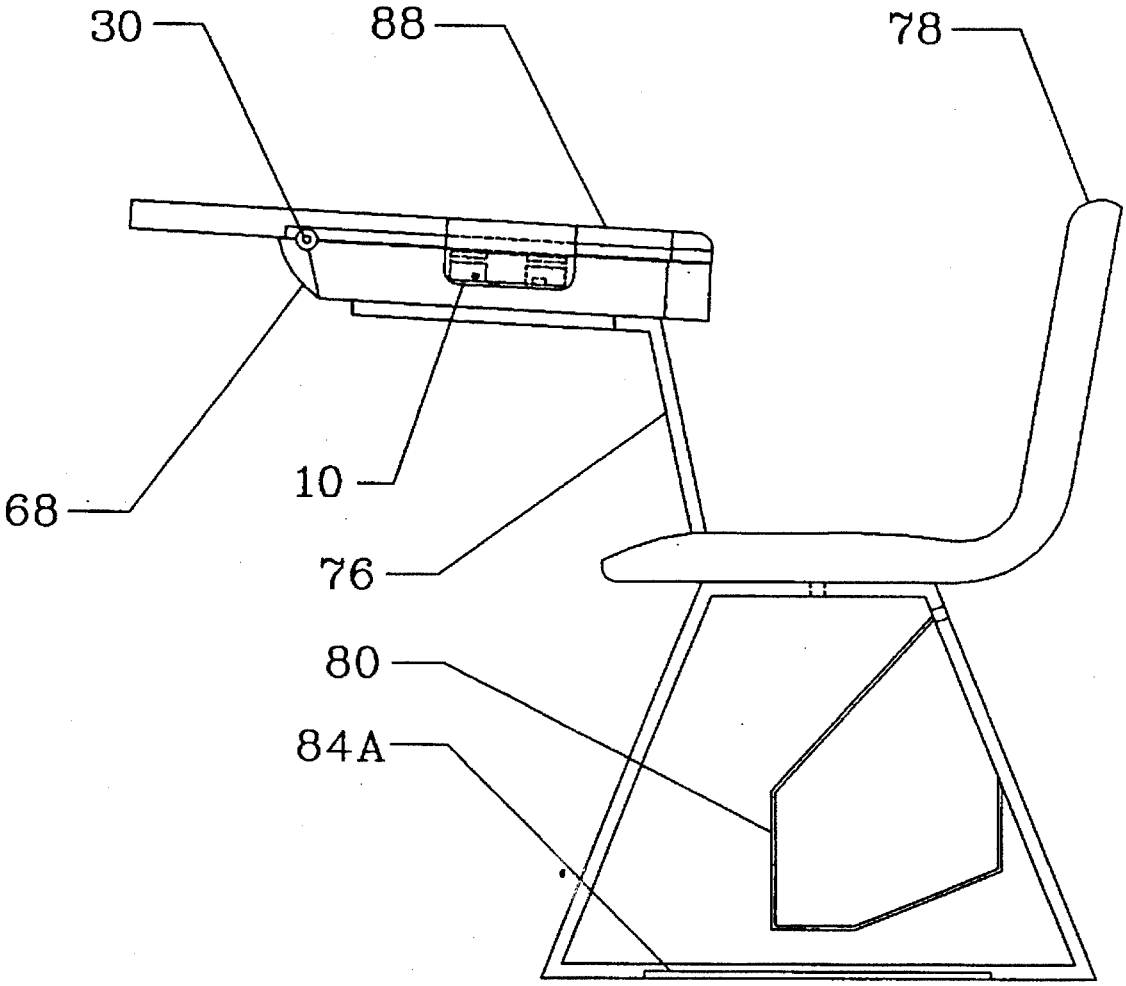
FIG. 3 shows the right side view of the desk-station, in the closed position.
Figure 3A:
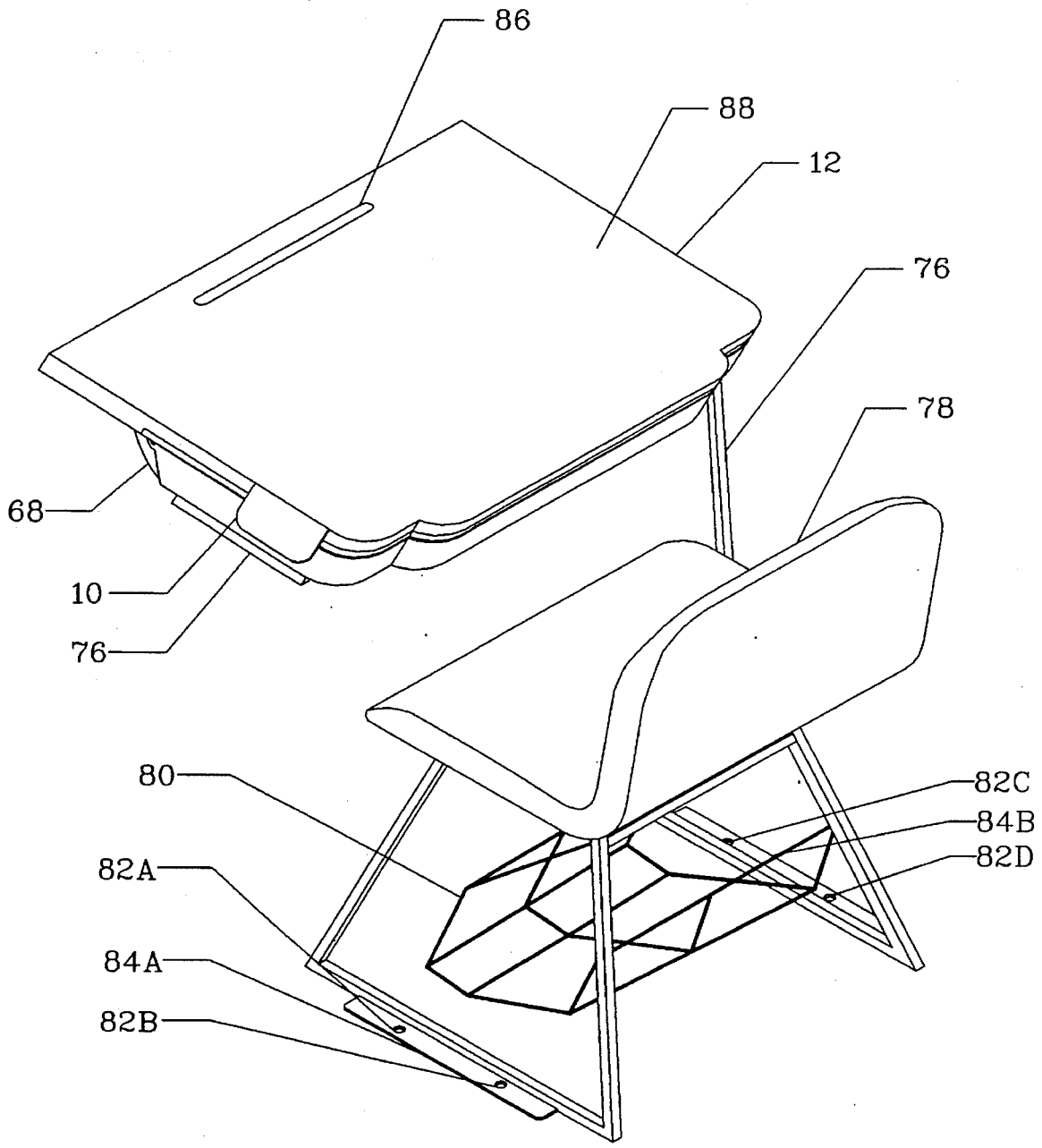
FIG. 3A shows an isometric view of the desk-station in the closed position, for use as a regular desk.
Figure 4:
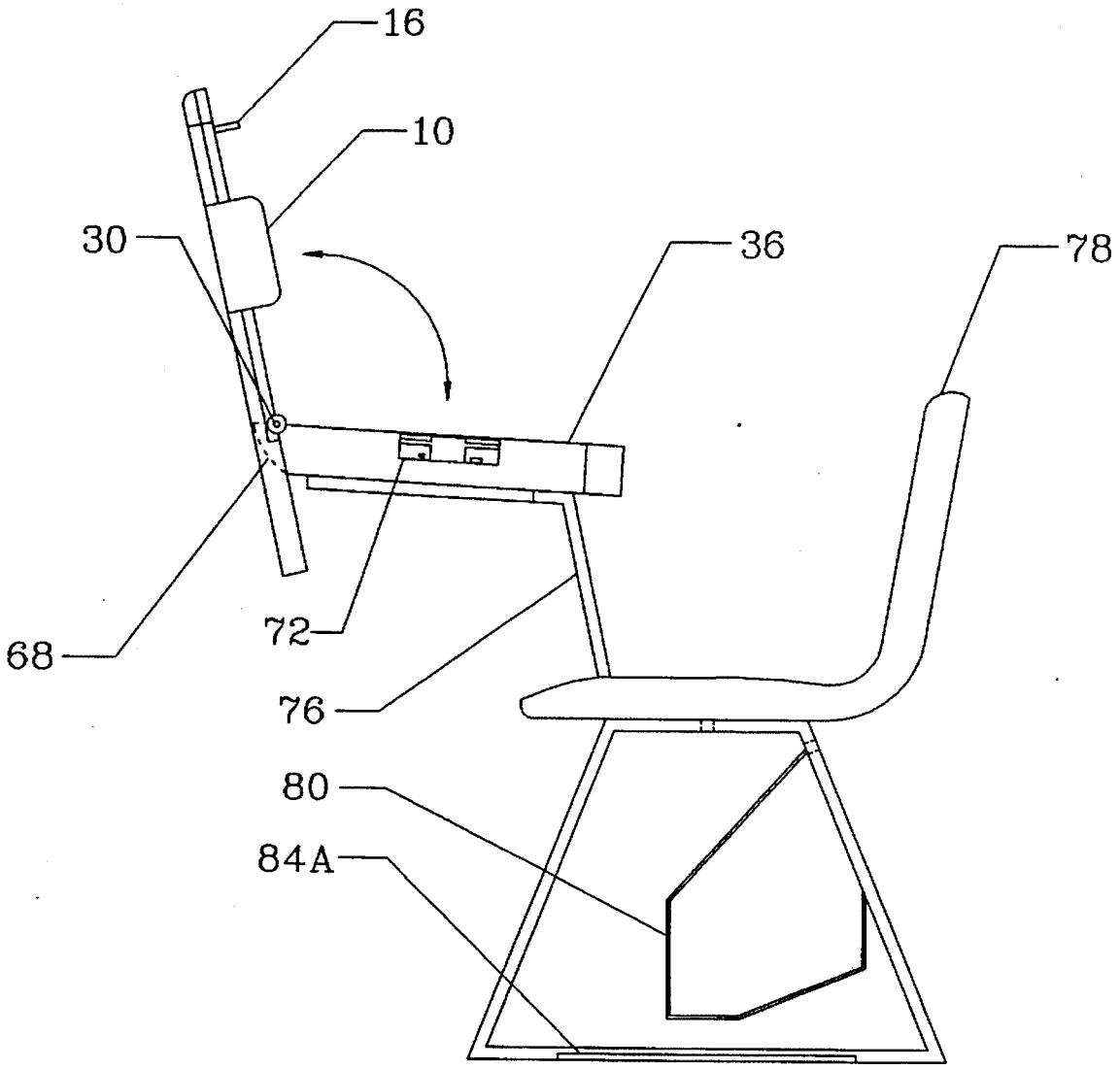
FIG. 4 shows the right side view of the desk-station in the open position.
Figure 4A:
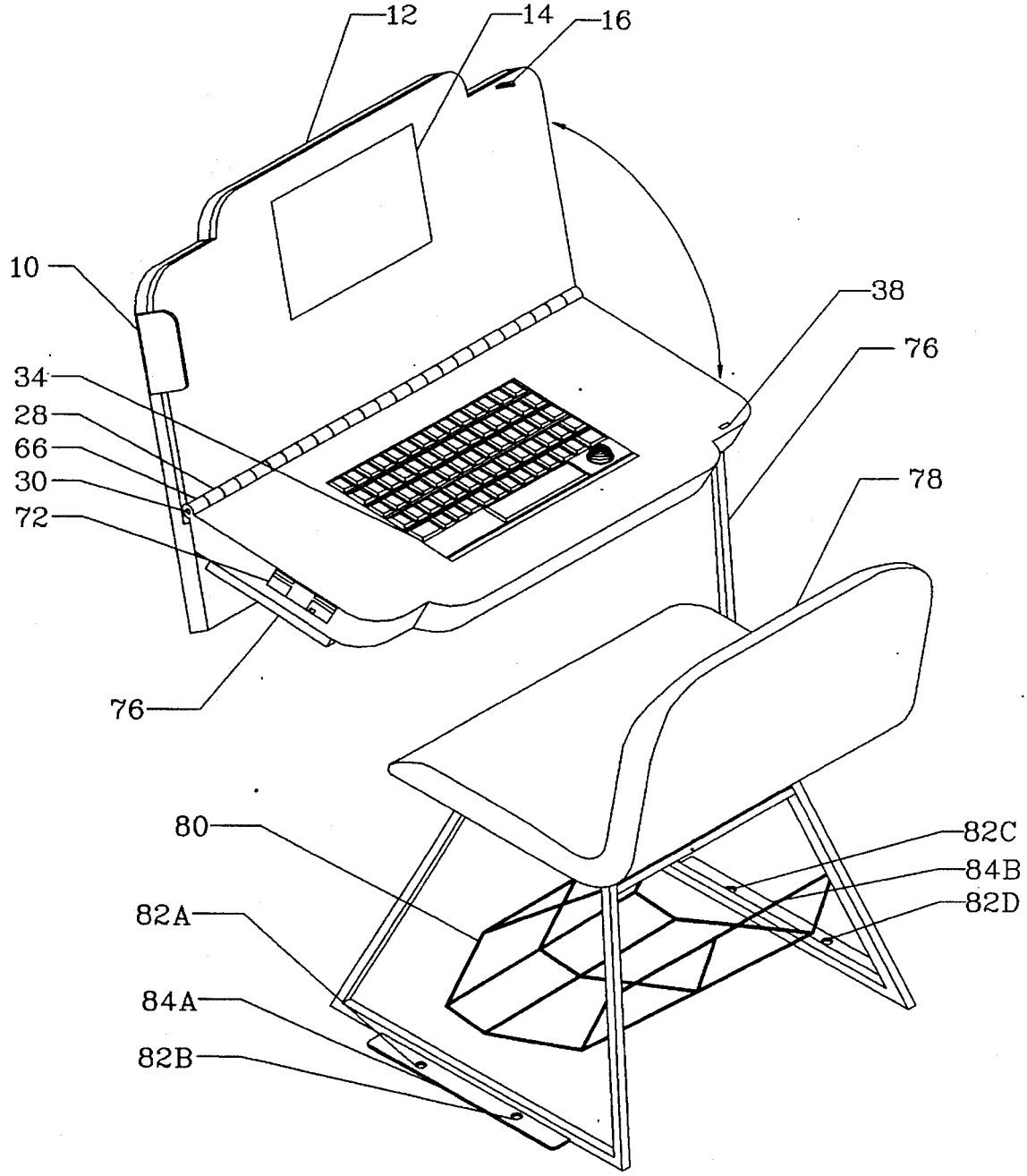
FIG. 4A shows an isometric view of the desk-station in the open position, for use as a computer station.
Figure 5:
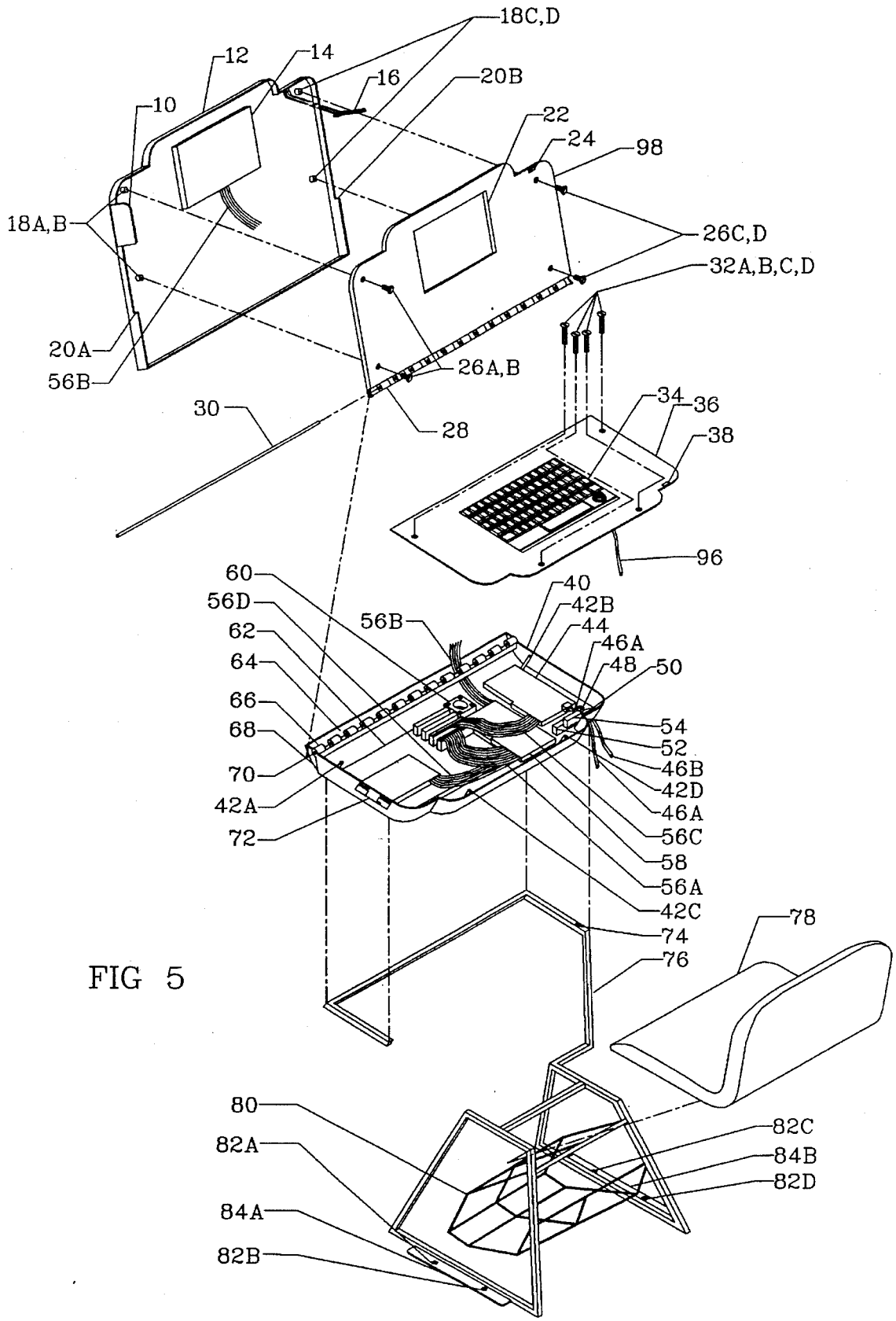
FIG. 5 shows an exploded isometric view of the desk-station.

A typical embodiment of the present invention is illustrated in FIG. 2, FIG. 3, FIG. 4, (side views) and FIG. 3A, FIG. 4A, and FIG. 5 (perspective views). FIG. 2, FIG. 3, and FIG. 3A show the invention in the closed position (desk application), while FIG. 4, FIG. 4A, and FIG. 5 show the invention in the open position (computer application). FIG. 5 consists of an exploded view illustrating the interrelationship of the components involved. FIG. 1 shows a detail of the electronic locking mechanism.

The Desk-Station is similar to a standard desk whose frame 76 has two metal flaps 84A and 84B on both sides the chair leg extension that serve to secure the desk to the floor by four bolts going through holes 82A–82D.

Frame 76 is typically ½ inch hollow tubing, which allows for network cable 46A and power cable 46B to enter frame 76 through hole 90, exiting hole 74, and entering cable access hole 48 at the base and on the right of component shell 40.

Book rack 80 is attached to frame 76. Seat 78 is secured to frame 76 by standard means (bolts, clamps, etc.) and can be made of any standard material used in similar applications.

Component shell 40 is attached to frame 76 by appropriate means (bolts, screws, etc.) and allows, as said above, network cable 46A and power cable 46B access through cable access hole 48. Component shell 40 also has a hole to allow for air circulation provided by fan 60 and the left side of component shell 40 is cut out to allow for access of floppy drive 72.

Component shell hinge 66 interlocks with display shell cover hinge 28 by means of hinge pin 30 going through hinge hole 70. The rear of component shell 40 is composed of wire protector 68, which is curved and allows for ribbon cable 56B to enter through wire access 64, formed by the space between display shell cover hinge 28, component shell hinge 66 and wire protector 68.

Component shell 40 houses standard size (8.5 inches by 13 inches) computer mother board 62 which is secured to component shell 40 by standard means. Connected to mother board 62 by ribbon cable 56A is a video/floppy card 58 which allows mother board 62 to interface with floppy drive 72 by means of ribbon cable 56D, and with video display 14 by means of ribbon cable 56B. Also connected to mother board 62 by means of ribbon cable 56C is a network interface card 44 which is connected to a local area network by means of network cable 46A. Power to mother board 62, floppy drive 72, fan 60 and servo motor 52 is secured by power cable 46B.

Input device 34 (typically a keyboard with trackball/mouse) is connected to mother board 62 by means of a keyboard cable 96. Input device 34 is inset and attached to component shell cover 36, so that it does not protrude above top surface of component shell cover 36.

Component shell cover 36 is attached to component shell 40 by means of screws 32A–D securing it to female screw attachments 42A–D.

Display shell cover 98 is secured to component shell 40 by means of component shell hinge 66 which interlocks with display shell cover hinge 28. Display cutout 22 is sized to allow for viewing of video display 14. Lock latch cutout 24 is also sized to allow for ridged lock latch 16 to fit through. Display shell cover 98 is attached to display shell 12 by screws 26A–D, that connect into female screw attachments 18A–d. The bottom left and right hand corners of display shell cover 98 are complemented by notches 20A–B. Video display 14 is mounted to the inside of display shell cover 98.

Floppy drive cover 10 extends off the left side of display shell 12 as a means to cover floppy drive 72 when the desk-station is in the closed position. The back side of display shell 12 consists of writing surface 88, a smooth surface, and pencil holder 86.

Ridged lock latch 16 is attached to display shell 12 and protrudes through lock latch cutout 24. When the desk-station is closed, ridged lock latch 16 is inserted through lock latch cutout 38 and interlocks with spring loaded lock latch 50. Spring lock latch 50 and spring 92 are enclosed by a spring and lock casing 54, which is indented on the underside and complemented by a gear 94. Gear 94 is driven by servo motor 52.

Materials used to cast the shell components can be of any of the normal types used for computer casings, such as hard plastics or formed metals. The thickness of such materials would typically be about ⅛ inch for plastic materials. The overall dimensions of desk top writing surface 88 is about 20 inches in length by 25 inches in width.

OPERATION-FIGS. 1, 3, 3A, 4, 4A

The manner of operation of the desk-station in a typical classroom setting would depend upon the instructor: if he/she decides reading and writing are to be done by traditional means, then the desk-station can remain in the closed position, whereby the writing surface is available, as seen in FIGS. 3 and 3A.

When the instructor turns on the file server at his/her desk all of the desk-stations will receive power from the main power supply causing each station to power up simultaneously, without the need for individual power supplies and power switches on each desk-station. Upon powering up electrical current activates the remote electronic locking mechanism, as seen in FIG. 1, current is received by servo motor 52, which turns gear 94 causing spring and latch casing 54 to move back, so that spring loaded lock latch 50 releases ridged lock latch 16 enabling the students to bring the desk-stations into the open position, as seen in FIGS. 4 and 4A.

The mode of operation for the desk-station once powered up would be the same as that of a personal computer on a local area network.

SUMMARY, RAMIFICATIONS, AND SCOPE

Thus the reader will see that the desk-station is both a practical and very useful educational tool: promoting computer literacy and at the same time remaining a safe and cost effective alternative to the typical computer work station.

While the above description contains many specifications, these should not be construed as limitations on the scope of the invention but rather as an exemplification of one preferred embodiment thereof. Other variations are possible, for example the desk-station could be fashioned into a wider desk for dual sitting arrangement. Another possibility would be to configure tables of various lengths in a similar manner as the desk-station itself except with the floppy drives located along the tables' front edge.

We claim:

1. A school desk or work station comprising, in combination:

a first surface generally horizontal with a top side that serves as a support means for reading or writing materials, said surface having an underside and inset substantially in the middle of said underside contains a thin flat video display;

a second surface of similar size and shape as said first surface consisting of a hollow housing having generally vertical sides, an underside and a top side having a sufficient section or plurality of sections removed to allow for the placement of input devices;

a hinge means attaching the bottom of said first surface to the top of said second surface, allowing for said first surface to be manually raised to a generally vertical, slightly slanted, position whereby access to said video display and said input devices is possible;

a rigid frame attached to the underside of said second surface and extending to the floor allowing said first and second surfaces to be at a sufficient height for operator access.

2. A school desk or work station according to claim 1, whereupon said first surface has an indentation on its top side that serves as a pen or pencil holder.

3. A school desk or work station according to claim 1, wherein said second surface has a section removed from one of its sides allowing for access to a secondary memory storage device.

4. A school desk or work station according to claim 3, wherein from said first surface a flap extends perpendicular from one of its sides in a downward position whereby said flap will prevent access to said secondary memory storage device when said first surface is in a generally horizontal position.

5. A school desk or work station according to claim 3, wherein a locking mechanism allows said first surface to be secured to said second surface.

6. A school desk or work station according to claim 5, wherein said locking mechanism can be remotely operated.

7. A school desk or work station according to claim 1, wherein said rigid frame is hollow, allowing power and communication cables to access said second surface through said hollow frame.

8. A school desk or work station according to claim 1, wherein said frame is attached to a chair.

9. A school desk or work station according to claim 8, where said chair is fixed to the floor.

* * * * *